US007379688B2

(12) United States Patent
Kikkawa

(10) Patent No.: US 7,379,688 B2
(45) Date of Patent: May 27, 2008

(54) IMAGE FORMING APPARATUS INCLUDING A REMOVABLE UNIT

(75) Inventor: Naoya Kikkawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 329 days.

(21) Appl. No.: 11/214,952

(22) Filed: Aug. 31, 2005

(65) Prior Publication Data

US 2006/0051129 A1 Mar. 9, 2006

(30) Foreign Application Priority Data

Sep. 7, 2004 (JP) ..... 2004-259904

(51) Int. Cl.
*G03G 15/00* (2006.01)

(52) U.S. Cl. ..... 399/117; 399/122

(58) Field of Classification Search ..... 399/116, 399/117, 122, 113

See application file for complete search history.

(56) References Cited

U.S. PATENT DOCUMENTS 4,609,277 A * 9/1986 Yokoyama et al. ..... 399/116
4,965,640 A * 10/1990 Watarai et al. ..... 399/122
5,201,852 A * 4/1993 Ogoshi ..... 432/60
5,839,032 A 11/1998 Yasui et al. ..... 399/124
6,819,895 B2 * 11/2004 Suzuki ..... 399/122

FOREIGN PATENT DOCUMENTS

JP 55164862 A * 12/1980
JP 04274451 A * 9/1992
JP 09-297440 11/1997
JP 10003215 A * 1/1998
JP 11305630 A * 11/1999
JP 2004-151568 5/2004

* cited by examiner

*Primary Examiner*—Robert Beatty
(74) *Attorney, Agent, or Firm*—Fitzpatrick, Cella, Harper & Scinto

(57) ABSTRACT

An image forming apparatus including a photosensitive drum unit (photosensitive unit) including a photosensitive body, a fixing unit for fixing a toner image transferred from the photosensitive body onto a recording material, and a vertical conveying path for conveying the recording material between the photosensitive drum unit and the fixing unit. Rails (guiding members) for guiding the removable photosensitive drum unit in a longitudinal direction are provided on the fixing unit. The rails are constituted of resin material capable of blocking heat transmitted towards the photosensitive drum unit.

18 Claims, 8 Drawing Sheets

FIG. 8 *PRIOR ART*
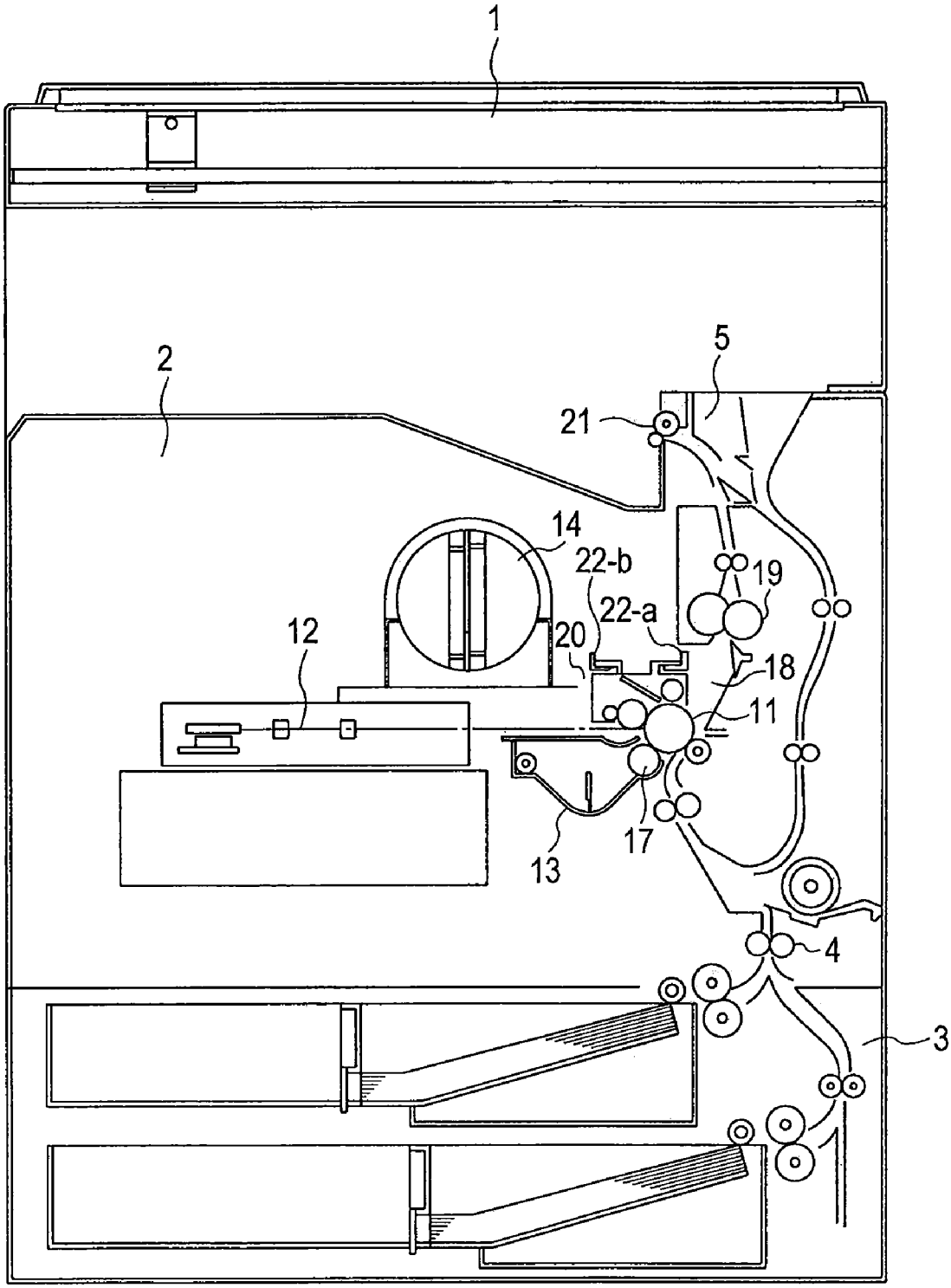

IMAGE FORMING APPARATUS INCLUDING A REMOVABLE UNIT

BACKGROUND OF THE INVENTION

1. Field of the Invention

The present invention relates to an image forming apparatus employing electrophotography or electrostatic recording and, more specifically, relates to an image forming apparatus, such as a copy machine, a printer, or a facsimile machine.

2. Description of the Related Art

Conventional vertical-path type image forming apparatuses having an image-forming unit disposed in a paper-conveying path (hereinafter referred to as 'vertical path') for conveying a sheet of paper from a lower side to an upper side of the image forming apparatus and then ejecting the sheet of paper from the image forming apparatus are discussed in Japanese Patent Laid-Open Nos. 09-297440 and 2004-151568.

Such image forming apparatuses, as illustrated in prior art FIG. 8, were realized as a result of digitalization. Digitalization has enabled a document image reader 1 that is a scanner for reading a document and an image-forming unit 2 that is a unit for carrying out an image-forming process in the image forming apparatus to be optically separated in the image-forming unit 2.

In such an image forming apparatus, optical information read out by the document image reader 1 is converted into an electronic signal at a photoelectric conversion unit, such as a charge-coupled device (CCD), and is sent to the image-forming unit 2. The electric signal is converted into an optical signal at a predetermined unit. In this way, image information is transmitted to a photosensitive drum 11 and a latent image is formed on the photosensitive drum 11.

Since the emission position of the optical signal may be any predetermined position, the flexibility of the position for the writing on the photosensitive drum 11 is increased. To correspond to this increased flexibility, a laser beam 12 has been used as a writing unit.

A vertical path type image-forming process has become possible to be employed in image forming apparatuses because of the technical development in draw-up systems and downward cleaning systems. A draw-up system is provided to supply toner upwards from image-forming units, such as a development unit 13 and a toner supplying unit 14, to the photosensitive drum 11 disposed above the image-forming units and to supply toner upwards from a developer or toner storage container to a development sleeve 17 disposed at a position higher than the developer or toner storage container. A downward cleaning system is provided to reliably clean the photosensitive drum 11 using a cleaning unit having an opening on the bottom that is contacts the photosensitive drum 11 for cleaning.

Since it has become possible to employ the vertical path system in an image forming apparatus, the image forming apparatus can employ a short-path structure wherein a paper conveying unit 18 and a fixing unit 19 are disposed above the image-forming units and an ejecting unit 5 and an ejecting slot 21 are disposed above the paper conveying unit 18 and the fixing unit 19. Image-forming units, including a paper-feeding unit 3 having a paper cassette, a registration unit 4, the photosensitive drum 11, the development unit 13, and the cleaning unit, are disposed in this order from the bottom in the image forming apparatus. According to this structure, the conveying path from the paper-feeding unit 3 to an ejecting unit 5 can be formed without extreme curving.

In this way, the conveying path becomes short and the number of components included in the conveying path can be reduced.

Furthermore, since the conveying path passes through the image forming apparatus relatively linearly, the space required for the conveying path is reduced. In this way, the size and cost of the image forming apparatus is reduced and the amount of time required for a sheet of paper to pass through the conveying path is reduced. Since the flexibility of the layout of each component in the image forming apparatus increases, the components can be disposed in a highly dense manner. As a result, the space required for disposing the components is reduced, and thus the size of the image forming apparatus is reduced.

However, the vertical path passing through a photosensitive drum unit 20 and the fixing unit 19 cannot be shortened in a conventional image forming apparatus since rails 22-*a* and 22-*b* configured to guide the photosensitive drum unit 20 during mounting or dismounting are disposed on the frame of the image forming apparatus. In other words, the size of a conventional image forming apparatus cannot be reduced by shortening the conveying path disposed between the photosensitive drum unit 20 and the fixing unit 19.

SUMMARY OF THE INVENTION

The size of the image forming apparatus according to an embodiment of the present invention can be reduced.

The size of the image forming apparatus according to an embodiment of the present invention can be reduced by providing an image forming apparatus including a first unit and a second unit. The first unit includes an image bearing member and is detachably mountable to the image forming apparatus. The second unit includes a fixing unit positioned and configured to fix a toner image, which is transferred from the image bearing member, on a recording material. The second unit is detachably mountable to the image forming apparatus. The second unit includes a guiding member configured and positioned to guide the first unit during mounting and dismounting of the first unit when the second unit is mounted to the image forming apparatus. In one embodiment, an upper position of the first unit slides along the guiding member in a longitudinal direction of the first unit during mounting and dismounting of the first unit and the second unit may be detachably mountable to the image forming apparatus in a direction orthogonal to a longitudinal direction of the second unit. In addition, the apparatus can also comprise an element configured and positioned to define a conveying path to convey the recording material from the first unit to the second unit, wherein the second unit is disposed on an upper side of the first unit. Also, another guiding member can be provided on the image forming apparatus. The another guiding member is configured and positioned to guide the first unit during mounting and dismounting of the first unit. The another guiding member is positioned across a vertical line passing through the center of gravity of the first unit from the guiding member of the second unit. In an alternative embodiment, the guiding member can be composed of a resin material configured and positioned to block heat transmitted towards the first unit. In addition, the apparatus can further comprise an exposure device configured and positioned to form an electrostatic image by projecting light of an image on the image bearing member, a development device configured and positioned to develop the electrostatic image on the image bearing member, and an optical discharging device configured and positioned to carry out optical discharging on the image bearing member. The exposure device, the development device, and the optical discharging device are disposed adjacent to the first unit horizontally besides, below, and above the first unit, respectively. In one embodiment, the guiding member comprises a rail and is supported by the fixing unit. In addition, an exposure unit can be provided that is configured and positioned to remove unevenness of charge on the image bearing member by exposing the image bearing member to an exposure beam. In this embodiment, the another guiding member is provided on the exposure unit and is positioned across a vertical line passing through the center of gravity of the first unit from the guiding member of the second unit. According to another aspect, the present invention relates to an image forming apparatus comprising first supporting means for supporting an image bearing means for bearing an image, the first supporting means being detachably mountable to the image forming apparatus, and second supporting means for supporting fixing unit for fixing a toner image, transferred from the image bearing means, on a recording material, the second supporting means being detachably mountable to the image forming apparatus. The second supporting means includes guiding means for guiding the first supporting means during mounting and dismounting of the first supporting means when the second supporting means is mounted to the image forming apparatus. The apparatus according to this aspect further comprises means for defining a conveying path to covey the recording material from the first supporting means to the second supporting means, wherein the second supporting means is disposed on an upper side of the first supporting means. In addition, an upper portion of the first supporting means slides along the guiding means in a longitudinal direction of the first supporting means during mounting and dismounting of the first supporting means. Also, according to this aspect, the apparatus further comprises another guiding means for guiding the first supporting means during mounting and dismounting of the first supporting means. The another guiding means is provided on the image forming apparatus. In addition, the another guiding means is positioned across a vertical line passing through the center of gravity of the first supporting means form the guiding means of the second supporting means. The guiding means can be composed of a resin material comprising means for blocking heat transmitted towards the first supporting means. Further, the second supporting means can be detachably mountable to the image forming apparatus in a direction orthogonal to a longitudinal direction of the second supporting means. According to one embodiment, the apparatus further comprises exposure means for forming an electrostatic image on the image bearing means by projecting light of an image on the image bearing means, development means for developing the electrostatic image on the image bearing means, and optical discharging means for optically discharging the image bearing means. The exposure means, the development means, and the optical discharging means are disposed adjacent to the first supporting means horizontally besides, below, and above the first supporting means, respectively. In one embodiment, the guiding means comprises a rail and is supported by the fixing unit. Also, in one embodiment, the apparatus can further comprise exposure means for removing unevenness of charge on the image bearing means by exposing the image bearing means to an exposure beam, and another guiding means for guiding the first supporting means during mounting and dismounting of the first supporting means, where the another guiding means is provided on the exposure means. Moreover, the another guiding means is positioned across a vertical line passing through the center of gravity of the first supporting means from the guiding means of the second supporting means.

Further features of the present invention will become apparent from the following description of exemplary embodiments (with reference to the attached drawings).

BRIEF DESCRIPTION OF THE DRAWINGS

FIG. 8 is a prior art view which illustrates a cross-sectional schematic view of a known image forming apparatus.

DESCRIPTION OF THE EMBODIMENTS

First Embodiment

Embodiments of the present invention will be described with reference to the drawings. The various structures according to the embodiments described below may be modified without departing from the spirit of the invention.

Figure 1:
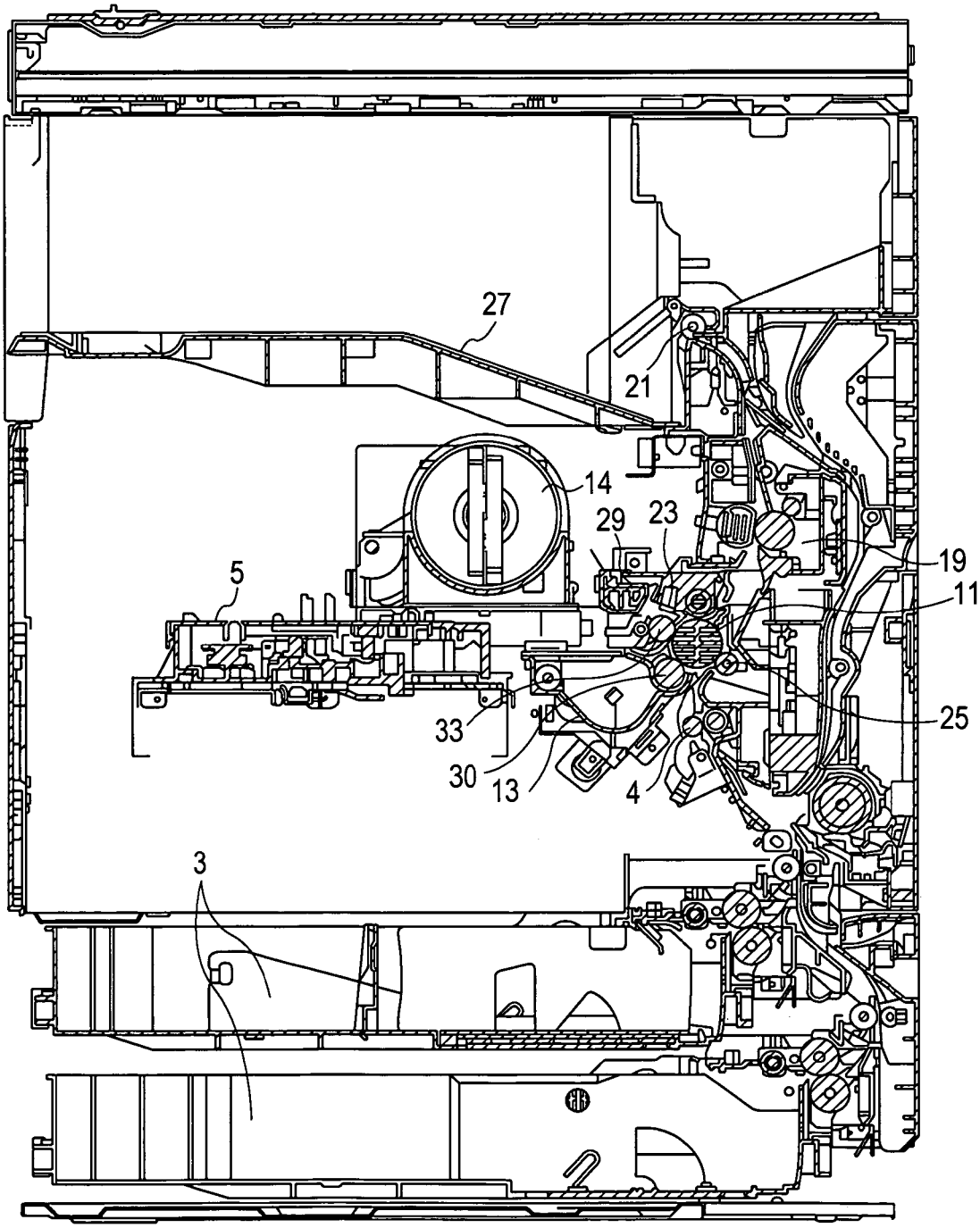
FIG. 1 illustrates a cross-sectional schematic view of the overall structure of an image forming apparatus according to an embodiment of the present invention.
Figure 2:
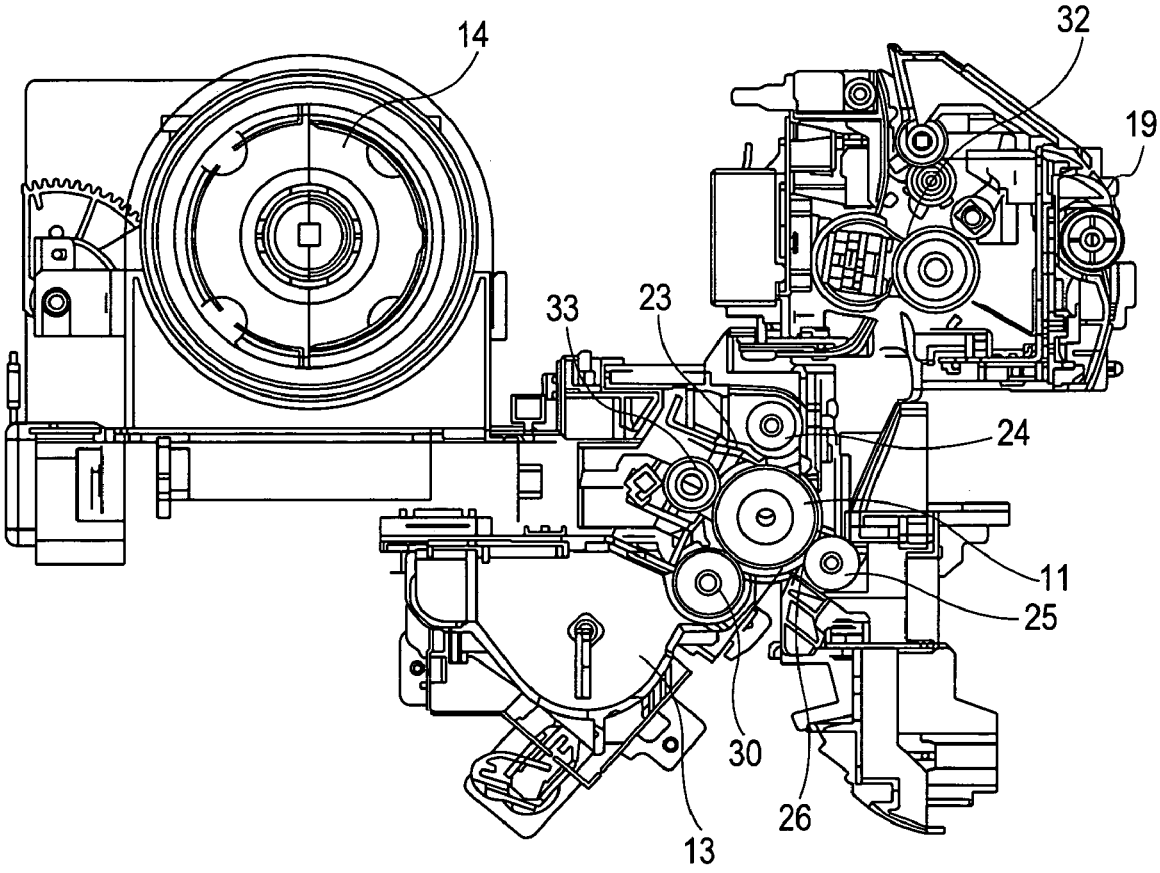
FIG. 2 illustrates a cross-sectional view of a photosensitive drum unit and its periphery in the image forming apparatus according to an embodiment.
Figure 3:
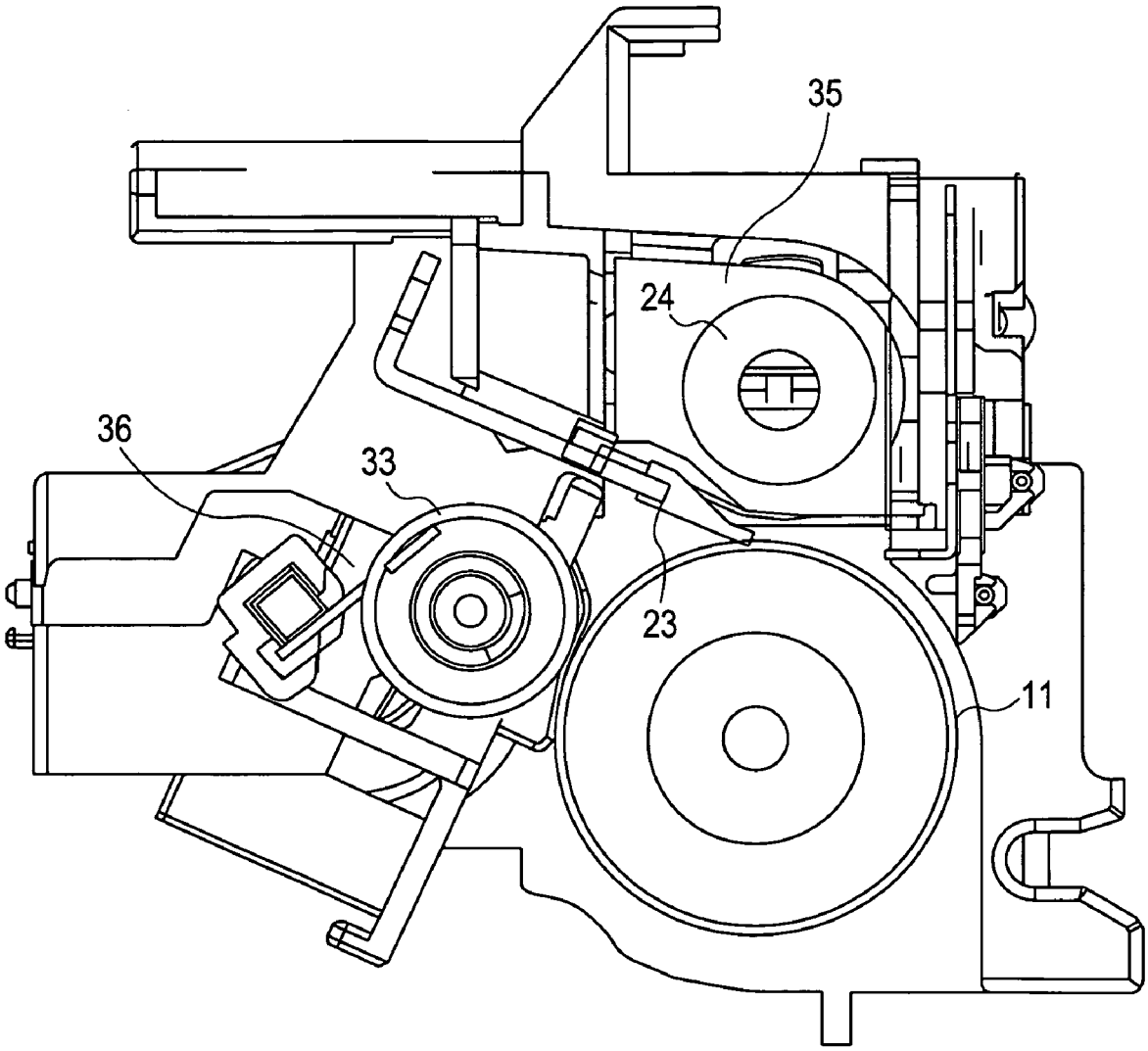
FIG. 3 illustrates cross-sectional schematic view of the photosensitive drum unit in the image forming apparatus according to an embodiment.
Figure 4:
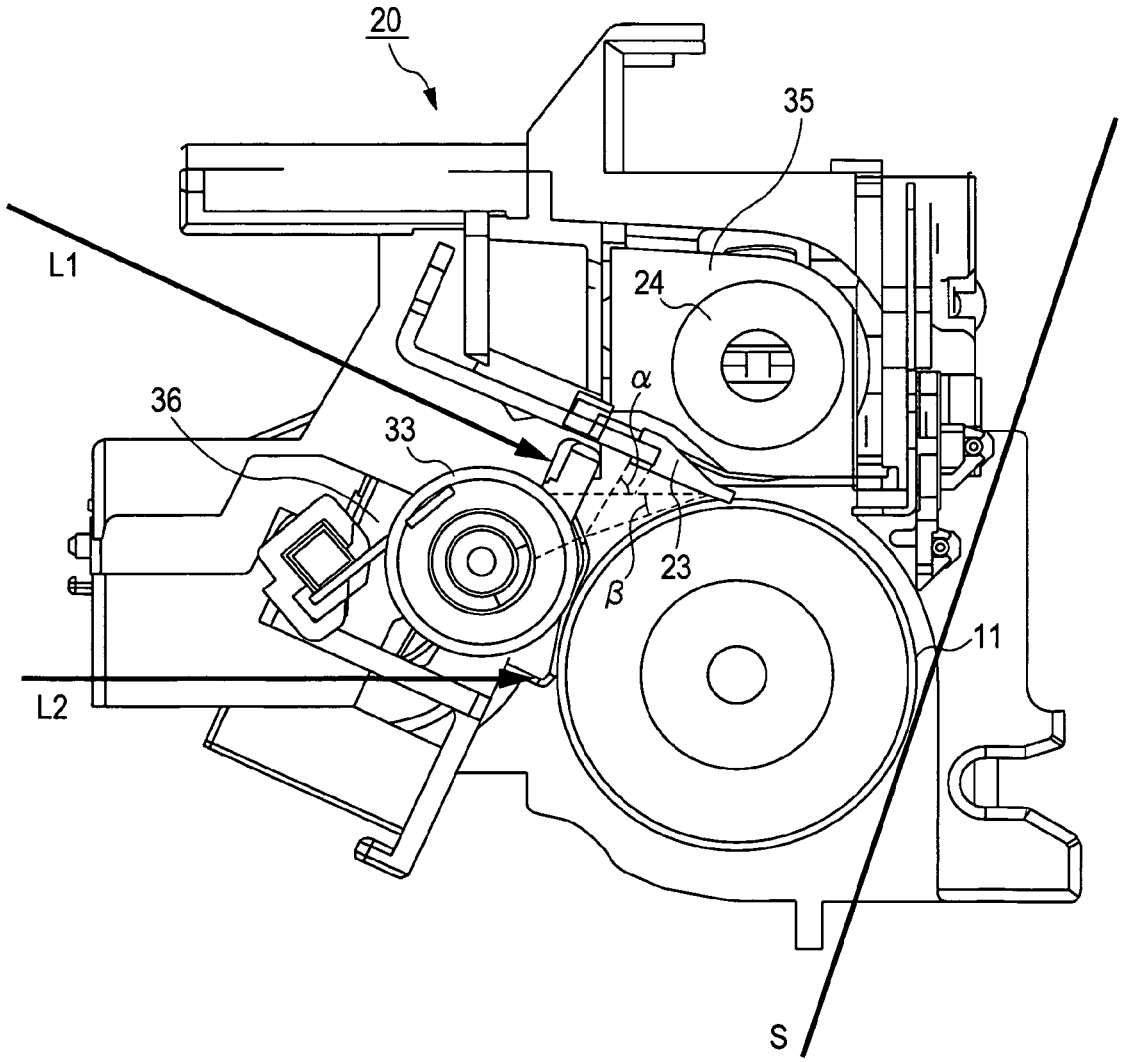
FIG. 4 illustrates cross-sectional schematic view of rails guiding the photosensitive drum unit according to an embodiment during mounting or dismounting.

FIG. 1 illustrates a cross-sectional view of the overall structure of an image forming apparatus according to an embodiment of the present invention. FIG. 2 illustrates a cross-sectional view of a photosensitive drum unit and its periphery in the image forming apparatus. FIG. 3 illustrates cross-sectional view of the photosensitive drum unit. FIG. 4 illustrates cross-sectional view of rails guiding the photosensitive drum unit.

As illustrated in FIGS. 1 and 2, an electrostatic latent image is formed on the surface of a photosensitive drum 11, which is an image bearing member uniformly charged by a charging roller 33, by scanning the surface of a photosensitive drum 11 with a laser beam from a laser scanner 5 in a manner corresponding to the image information so that light of an image is projected on the photosensitive drum 11. Toner is applied on the electrostatic latent image by a development unit 13 so as to develop the electrostatic latent image as a toner image. The development unit 13 is positioned below a photosensitive drum unit 20. The toner image is transferred onto a sheet of paper by a transfer roller 25. The sheet of paper is conveyed by registration rollers 4 in synchronization with the rotation of the photosensitive drum 11.

To supply toner to the photosensitive drum 11, the toner supplied from a toner supplying unit 14 is sent to the development unit 13. Then, as the toner is stirred inside the development unit 13, the toner reaches a development sleeve 30. The toner supplied from the development sleeve 30 to the photosensitive drum 11 is used to develop the electrostatic latent image to form a toner image from the electrostatic latent image on the photosensitive drum 11. After transferring the toner image onto a sheet of paper, the residual toner on the photosensitive drum 11 is removed by a cleaning member 23 in contact with the photosensitive drum 11, as illustrated in FIG. 3. Then, the removed toner is collected in a waste toner container (not shown in the drawing) by a conveying screw 24. The photosensitive drum 11 cleaned by removing the residual toner is exposed by an exposure unit 29 so as to remove the unevenness in the surface charge by carrying out optical discharge of the photosensitive drum 11. The exposure unit 29 is disposed above the photosensitive drum unit 20. Then, the photosensitive drum 11 is uniformly charged by the charging roller 33 to prepare for the formation of another latent image.

Sheets of paper are conveyed from a paper-feeding unit 3 to a transfer nip 26 between the photosensitive drum 11 and the transfer roller 25 (refer to FIG. 2). In this way, the toner image formed on the photosensitive drum 11 is transferred onto the sheet of paper. Then, the sheet of paper having the toner image passes through a fixing unit 19 disposed on an upper side of a photosensitive drum unit 20. The sheet is heated and pressed by the fixing unit 19 so that the toner image is fixed to the surface of the sheet of paper. The sheet having the fixed toner image is passed through an ejection slot 21 and is ejected from an in-body ejection slot 27.

Next, the photosensitive drum unit 20, which is a first unit of the image forming apparatus, will be described with reference to FIGS. 1 to 4.

The image forming apparatus according to this embodiment includes a photosensitive drum unit 20 and other units for image forming disposed around the photosensitive drum 11, as illustrated in FIG. 4. The units for image forming are not disposed across a nip line S of a transfer unit from the photosensitive drum 11 because a paper-conveying path is provided in the position across the nip line S from the photosensitive drum 11. The nip line S is a line tangent to the transfer unit of the photosensitive drum 11. For this reason, the photosensitive drum unit 20 and other units are disposed on the same side of the nip line S as the photosensitive drum unit 20. The process performed by this image forming apparatus includes the steps of cleaning residual toner by the cleaning member 23, removing unevenness in charge by exposing the photosensitive drum 11 with an exposure beam L1 by the exposure unit 29, charging the photosensitive drum 11 by the charging roller 33, forming an electrostatic latent image by a laser beam L2, and forming a toner image by supplying toner from the development sleeve 30 and is carried out on the same side of the nip line S as the photosensitive drum 11.

As illustrated in FIG. 1, the laser scanner 5 of the image forming apparatus according to this embodiment is spaced from the drum unit 20 in a horizontal direction and extends substantially horizontally with respect to the ground in a manner such that the laser beam L2 is directly projected substantially horizontally onto the photosensitive drum 11 without needing to be reflected at a mirror. In this way, the production cost of the apparatus can be reduced. Because of this structure, the height of the photosensitive drum 11 at which a latent image is formed by the laser beam L2 is substantially the same height as the center of the photosensitive drum 11. Consequently, a cleaning unit 35 including the cleaning member 23 and the conveying screw 24, the exposure unit 29, and a charging roller unit 36 are disposed around the photosensitive drum 11 between the nip line S of the transfer unit and the laser beam L2 in a counterclockwise direction.

The cleaning unit 35 cleans off residual toner by disposing the cleaning member 23 in contact with the photosensitive drum 11 and rotating it in a direction opposite to the rotational direction of the photosensitive drum 11. While cleaning, the angle β between the cleaning member 23 and the line tangent to the contact point on the photosensitive drum 11 and the contact pressure of the cleaning member 23 against the photosensitive drum 11 are set appropriately to enable sufficient cleaning and to prevent damaging of the photosensitive drum 11. The angle β is set to about 30° according to this embodiment. The contact pressure of the cleaning member 23 is based on the elasticity of the cleaning member 23. For this reason, the cleaning member 23 includes a predetermined free length.

The waste toner removed from the photosensitive drum 11 by the cleaning member 23 is collected in a space in which the conveying screw 24 is disposed before being sent to a waste toner container (not shown in the drawings) by the conveying screw 24. This space can be provided on a side of the cleaning member 23 that is positioned against the rotation of the photosensitive drum 11. The conveying screw 24, which has a diameter of about 14 mm, is disposed in the vicinity of the cleaning member 23 so as to efficiently send the waste toner to the waste toner container.

If, for example, the position of the cleaning unit 35 is changed from the position illustrated in FIG. 4 to a position towards the left (the cleaning unit 35 cannot be moved to the right because of the vertical conveying path), angle α becomes smaller than the angle illustrated in the drawing because the angle β between the cleaning member 23 and the tangent line to the photosensitive drum 11 at the contact point with the cleaning member 23 has to be maintained. As a result of this arrangement, the space required in the horizontal direction increases. On the other hand, the cleaning member 23 cannot be moved to the right, as mentioned above, because there is not enough space on the right to fit the conveying screw 24, which requires a diameter of at least 14 mm for normal operation.

The cleaning unit 35 according to this embodiment, as illustrated in FIG. 4, is disposed in a space extending in a counterclockwise direction from the vicinity of the vertical conveying path of the photosensitive drum unit 20. In this way, the entire size of the image forming apparatus is reduced.

The charging roller unit 36 includes the charging roller 33 and a pressurizing mechanism (not shown in the drawing) for pressing against the photosensitive drum 11. The diameter of the charging roller 33 is set at 16 mm for normal operation to correspond to the photosensitive drum 11 having a diameter of 30 mm. Accordingly, the charging roller unit 36 requires a predetermined space, as illustrated in FIG. 4.

Since the exposure beam L1 is projected onto the photosensitive drum 11 from between the cleaning member 23 and the charging roller 33, space is provided for the laser beam to pass through between cleaning unit 35 and the charging roller unit 36.

For the reasons described above, the cleaning unit 35, the space for the light path of the exposure beam L2, and the charging roller unit 36 are disposed in this order in the counter clockwise direction from the nip line S with almost no space between each unit except for a space sufficient for laser beam L2 to pass.

The development sleeve 30 of the development unit 13 is disposed more downstream with respect to the rotation of the photosensitive drum 11 than the incident point of the laser beam L2 and more upstream with respect to the rotation of the photosensitive drum 11 than the paper-feeding path from the registration rollers 4 to the transfer nip 26.

The mounting and dismounting directions of units included in the body of the image forming apparatus are described with reference to FIGS. 5 and 6.

Figure 5:
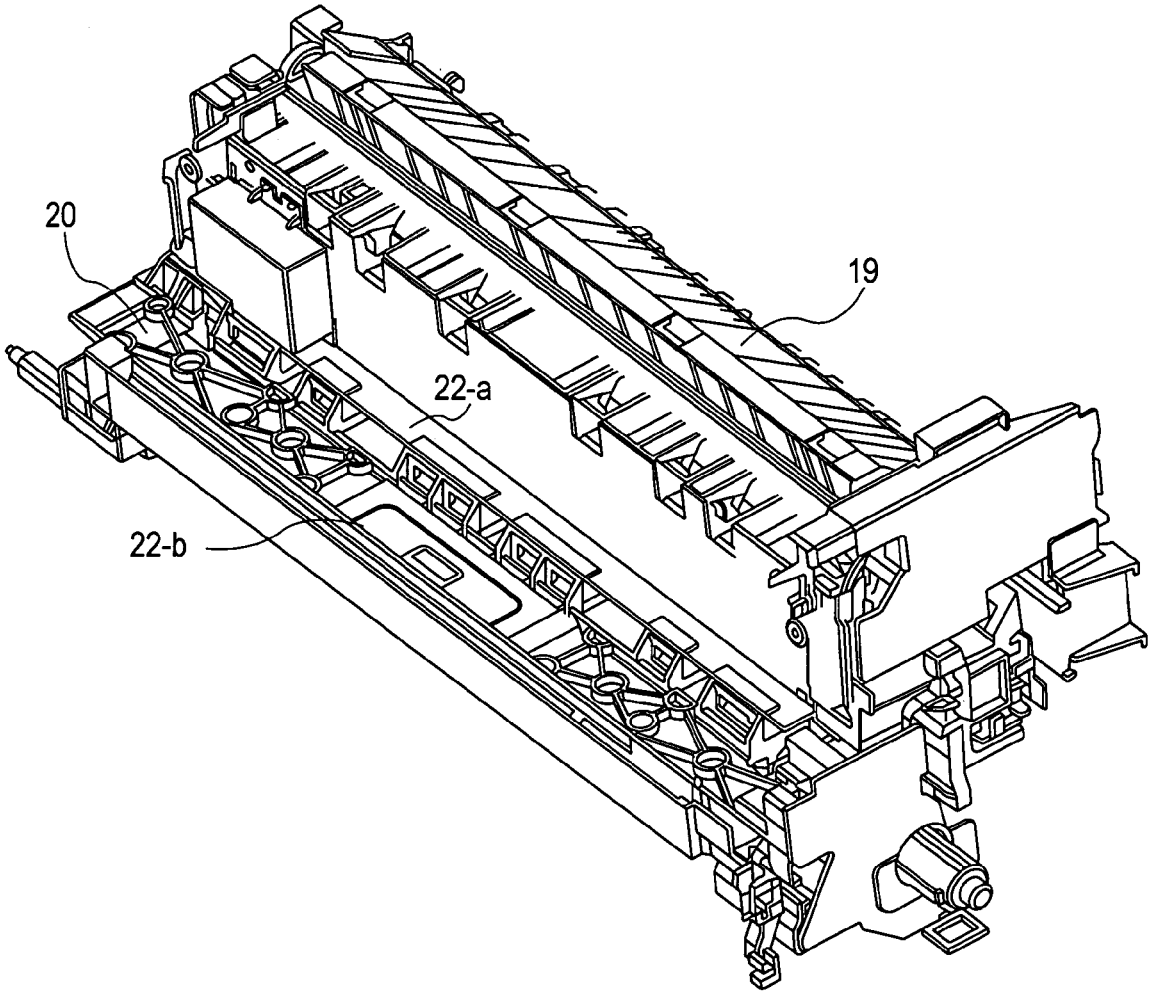
FIG. 5 illustrates a perspective view indicating the mounting and dismounting direction of the photosensitive drum unit according to an embodiment.
Figure 6A:
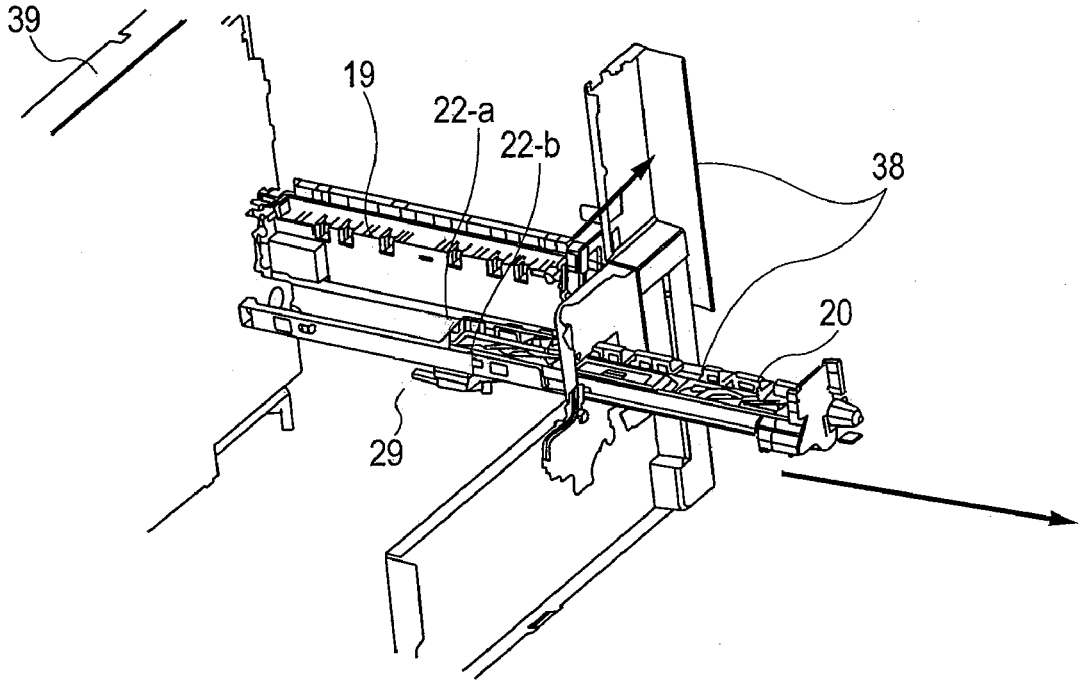
FIGS. 6A and 6B illustrate perspective views indicating the mounting and dismounting directions of a development unit of the image forming apparatus, a fixing apparatus, and the photosensitive drum unit according to an embodiment.
Figure 6B:
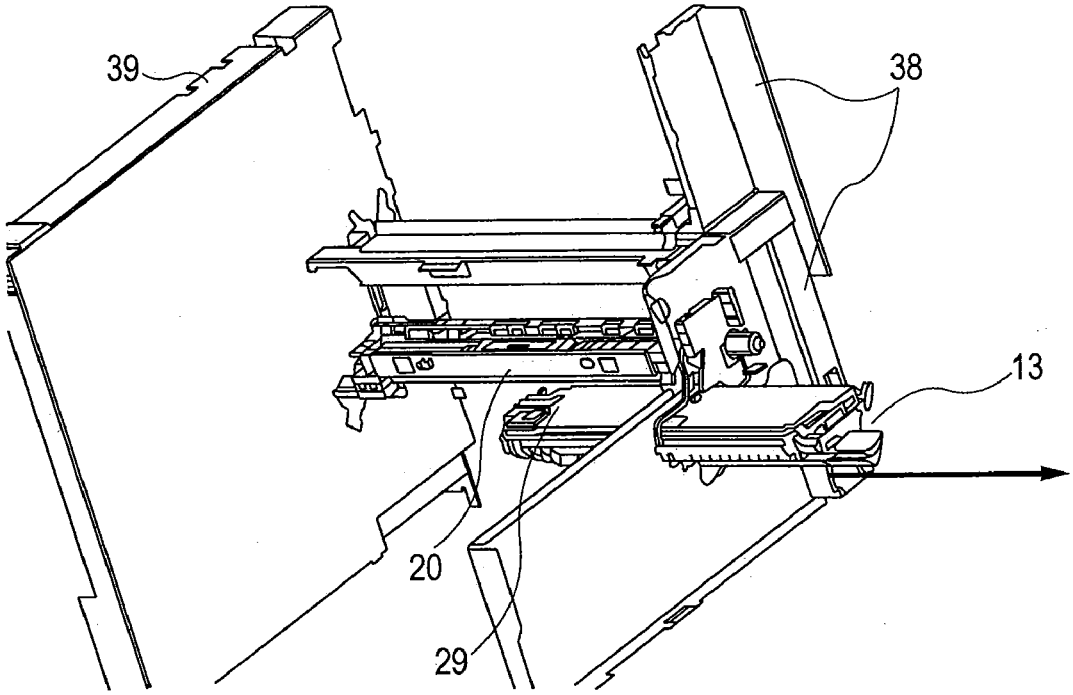

FIG. 5 illustrates a perspective view indicating the mounting and dismounting directions of the photosensitive drum unit 20 and the fixing unit 19, which are first and second units of the image forming apparatus, respectively. FIGS. 6A and 6B illustrate perspective views indicating the mounting and dismounting directions of the photosensitive drum unit 20 and the fixing unit 19.

The photosensitive drum unit 20, the development unit 13, and the fixing unit 19 often have shorter lives than the body of the image forming apparatus. Therefore, these units are periodically replaced by a service person or the user each time the life of any of the units expires. The units can be removed from the body of the image forming apparatus as described below.

The photosensitive drum unit 20 is fixed to the front panel 38 of the body of the image forming apparatus with screws (not shown). By removing the screws, the photosensitive drum unit 20 can be slid out in the longitudinal direction (i.e., towards the front side) of the photosensitive drum 11 along rails 22-*a* and 22-*b*, which are guiding members, as illustrated in FIG. 5 and FIG. 6A.

The development unit 13 is fixed to the front panel 38 of the body of the image forming apparatus with screws. By removing the screws, development unit 13 can be pulled out in the longitudinal direction (i.e., towards the front side) of the photosensitive drum 11 along rails not shown in the drawings, as illustrated in FIG. 6B.

The fixing unit 19, as illustrated in FIG. 6A, is pulled out in a direction orthogonal to the generatrix of the photosensitive drum 11 (i.e., the longitudinal direction of the photosensitive drum unit 20) and parallel to the ground, as illustrated in FIG. 6A.

Since the exposure unit 29 does not have to be replaced, it is fixed to the front panel 38 and the rear panel 39 of the body of the image forming apparatus.

Next, the positions of the rails 22-*a* and 22-*b* for mounting and dismounting the photosensitive drum unit 20 by permitting the upper portion of unit 20 to slide therealong in the longitudinal direction of unit 20 will be described with reference to FIG. 7.

The photosensitive drum unit 20 according to this embodiment is removed from the body of the image forming apparatus by being pulled out in a direction substantially parallel to the generatrix of the photosensitive drum 11, as illustrated in FIG. 6A. In such a structure, the rails 22-*a* and 22-*b* are disposed respectively on the right and left of a vertical line G1 passing through the center of gravity, centroid, or barycenter of the photosensitive drum unit 20 on either side of which the drum unit 20 has the same mass and weight to keep the weight balance. Ideally, the distances from the line GI to the rails 22-*a* and 22-*b* are equal.

If the positions of the rails 22-*a* and 22-*b* illustrated in FIGS. 5 and 6A are not adjusted appropriately, the photosensitive drum 11 will be unstable when mounting or dismounting the photosensitive drum unit 20. Since the size of the image forming apparatus is reduced, various units (not shown in the drawings) are disposed in the vicinity of the path for mounting and dismounting the photosensitive drum unit 20. Therefore, if the photosensitive drum 11 is not stable when mounting or dismounting the photosensitive drum unit 20, these units may be damaged by the photosensitive drum 11. As a result, faulty images may be generated. If only one rail is provided for the mounting and dismounting of the photosensitive drum unit 20, the rail must be disposed accurately at the line GI. In order to dispose the rail in such a manner, extremely high accuracy is required. Even if the rail is disposed accurately, the position of the photosensitive drum 11 may become unstable due to a great rotational force that is generated when force is applied to a position away from the center of gravity of the photosensitive drum unit 20 during mounting or dismounting.

Due to the above-described reasons, two rails (the rails 22-*a* and 22-*b*) are provided and the rails 22-*a* and 22-*b* are disposed on the right and left respectively of the line G1 of the photosensitive drum unit 20. The horizontal line G2 passing through the center of gravity, barycenter, or centroid of the drum unit 20 on either side of which the drum has the same mass and weight does not have to be considered since gravity is applied in the vertical direction.

Next, the position of the rail 22-*a* disposed closer to the vertical conveying path than the line G1 of the photosensitive drum unit 20 will be described with reference to FIG. 7.

The space on the right of the line G1 and below the line G2 of the photosensitive drum unit 20 is used for supplying toner from the development sleeve 30 to the photosensitive drum 11 and for conveying sheets of paper. Therefore, the photosensitive drum 11 is uncovered in this space and the rail 22-*a* is preferably not disposed in this space.

Consequently, the rail 22-*a* is preferably disposed in the space on the right of the line G1 and above the line G2. In this space the photosensitive drum unit 20, and the development unit 13 are disposed, as described above with reference to FIG. 4. Therefore, it is possible to provide surfaces 37-*a* and 37-*b* for receiving the rail 22-*a* at the upper portion of the cleaning unit 35.

If the rail 22-*a* is disposed at the above-described space on the frame (on the front panel 38 and the rear panel 39) of the image forming apparatus according to this embodiment having a reduced-size by shortening the vertical conveying path, the necessary cross-sectional area cannot be obtained because the fixing unit 19 is disposed in the space. Consequently, the strength of the rail 22-*a* is reduced and the rail 22-*a* will fail to operate adequately. As a result, the rail 22-*a* will be an obstacle to the reduction in size of the image forming apparatus by shortening the vertical conveying path. Therefore, in the image forming apparatus according to this embodiment, a conveying guide (inlet guide) (not shown in the drawing) configured and positioned to define a conveying path to convey or guide sheets of paper from the photosensitive drum unit 20 to a fixing nip 32 of the fixing unit 19 is extended to enable the rail 22-*a* to function sufficiently. In such a structure, although the cross-sectional area of the rail 22-*a* functioning sufficiently is small, the rail can be supported by the fixing unit 19. Accordingly, the rail will have sufficient strength to function satisfactorily.

Next, the position of the rail 22-*b* disposed further away from the vertical conveying path than the line G1 of the photosensitive drum unit 20 (on the left in FIG. 7) will be described with reference to FIG. 7.

Figure 7:
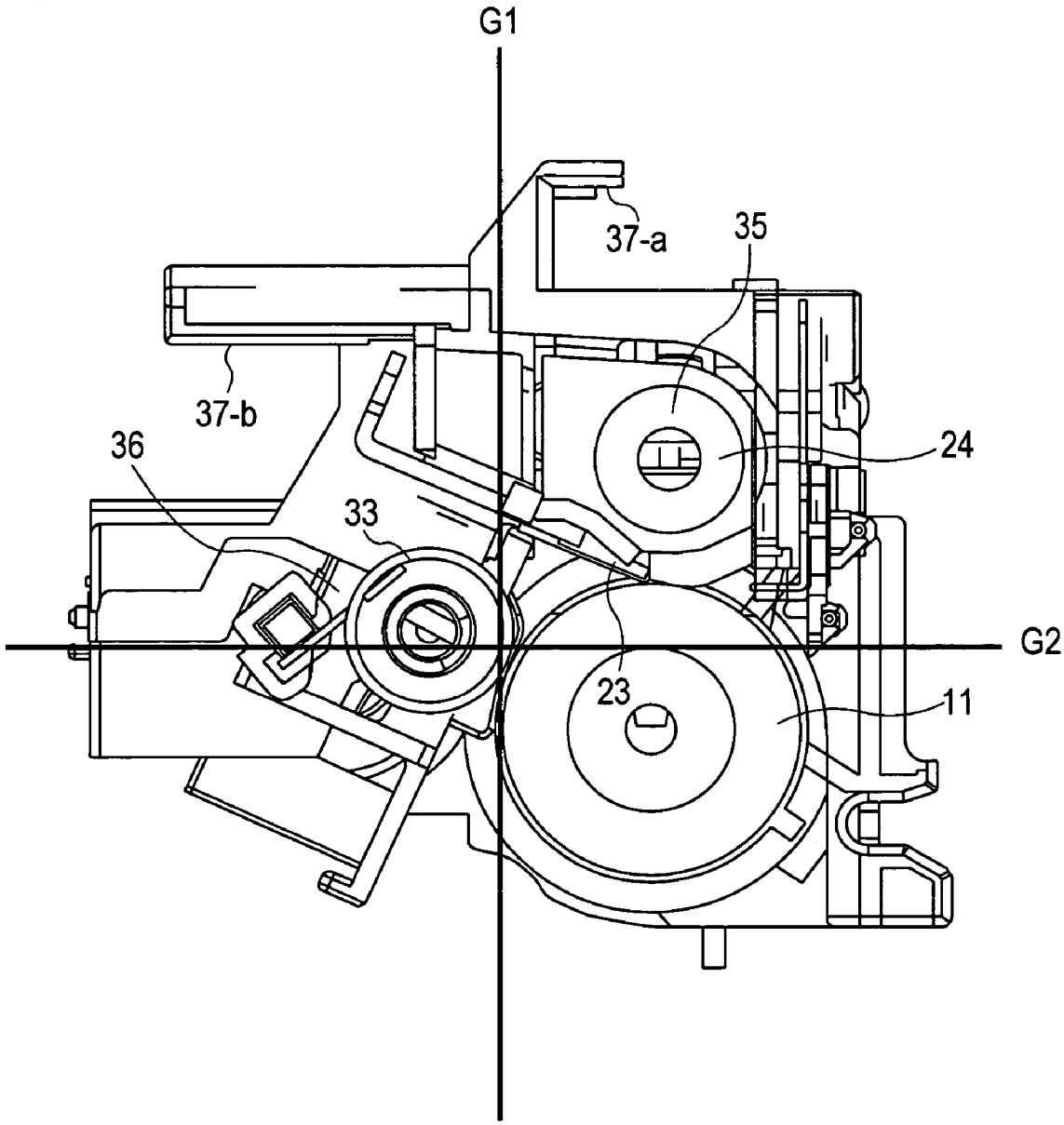
FIG. 7 illustrates a cross-sectional schematic view of the position of the rails used for mounting and dismounting the photosensitive drum unit according to an embodiment.

To the left of the line G1 from the vertical conveying path in FIG. 7 and above the line G2, there is a space provided above the cleaning unit 35 and the exposure unit 29, as described above. By disposing the rail 22-*b* in this space, the rail 22-*a*, together with the rail 22-*b*, stabilizes the position of the photosensitive drum 11 during mounting or dismounting of the photosensitive drum unit 20. In this way, generation of faulty images due the photosensitive drum 11 colliding with the units disposed in the vicinity of the photosensitive drum unit 20 so as to reduce the size of the image forming apparatus can be prevented. At the same time, the vertical conveying path can be shortened to reduce the size of the image forming apparatus.

In this embodiment, the exposure unit 29 is disposed adjacent to the photosensitive drum 11, as described above, on the left side of the line G1 and is fixed to the frame (front panel 38 and rear panel 39) of the body of the image forming apparatus as a unit independent of the photosensitive drum unit 20. By using the external portion of the exposure unit 29 as a guiding rail 22-*b*, the photosensitive drum unit 20 can be aligned with the exposure unit 29. Accordingly, an additional rail does not have to be provided, as in a known image forming apparatus.

By using the rail 22-*b* together with the above-mentioned rail 22-*a* on the right, the photosensitive drum 11 can be stabilized during mounting and dismounting of the photosensitive drum unit 20, the generation of faulty images due to the photosensitive drum 11 colliding with the units disposed in the vicinity of the photosensitive drum unit 20 can be prevented, the photosensitive drum unit 20 can be easily aligned with the exposure unit 29, and the vertical conveying path can be shortened so as to reduce the size of the image forming apparatus.

In an image forming apparatus according to another embodiment, the rail 22-*a* is included in the fixing unit 19 and may also be a resin member for protecting the photosensitive drum 11 from heat transmitted from the fixing unit 19. In this way, an additional heat shield, which is required because the fixing unit 19 and the photosensitive drum 11 are disposed closely to each other, does not have to be provided. As a result, the size and cost of the image forming apparatus can be reduced.

According to this embodiment, by supporting one of the guiding members used for mounting and dismounting the photosensitive unit with the fixing unit 19, the distance between a photosensitive unit and the fixing unit 19 can be reduced compared to a known image forming apparatus in which the guiding member is provided on the frame of the body of the image forming apparatus. As a result, the size of the image forming apparatus can be reduced by shortening the vertical conveying path.

By constituting the guide member of a resin material for blocking heat transmitted towards the photosensitive unit, an additional heat shield does not have to be provided to block the heat transmitted to the photosensitive unit. Accordingly, the size and cost of the image forming apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-259904 filed Sep. 7, 2004, which is hereby incorporated by reference herein in its entirety.

What is claimed is:

1. An image forming apparatus comprising:

a first unit including an image bearing member, the first unit being detachably mountable to the image forming apparatus; and a second unit including a fixing device positioned and configured to fix a toner image on a recording material, transferred from the image bearing member, the second unit being disposed on an upper side of the first unit; and a conveying path to convey the recording material from the first unit to the second unit, wherein the second unit includes a guiding member configured and positioned to guide the first unit during mounting and dismounting of the first unit when the second unit is mounted to the image forming apparatus.

2. The image forming apparatus according to claim 1, wherein the upper portion of the first unit slides along the guiding member in a longitudinal direction during mounting and dismounting of the first unit.

3. The image forming apparatus according to claim 1, further comprising:

another guiding member provided on the image forming apparatus, the another guiding member being configured and positioned to guide the first unit during mounting and dismounting of the first unit, wherein the another guiding member is positioned across a vertical line passing through the center of gravity of the first unit from the guiding member of the second unit.

4. The image forming apparatus according to claim 1, wherein the guiding member is composed of a resin material configured and positioned to substantially block heat transmitted towards the first unit.

5. The image forming apparatus according to claim 1, wherein the second unit is detachably mountable to the image forming apparatus in a direction orthogonal to a longitudinal direction of the second unit.

6. The image forming apparatus according to claim 1, further comprising:

an exposure device configured and positioned to form an electrostatic image by emitting light of an image on the image bearing member;

a development device configured and positioned to develop an electrostatic image on the image bearing member; and an optical discharging device configured and positioned to carry out optical discharging on the image bearing member, wherein the exposure device, the development device, and the optical discharging device are disposed adjacent to the first unit horizontally besides, below, and above the first unit, respectively.

7. The image forming apparatus according to claim 1, wherein the guiding member comprises a rail.

8. The image forming apparatus according to claim 1, wherein the guiding member is supported by the fixing device.

9. The image forming apparatus according to claim 1, further comprising:

an exposure unit configured and positioned to remove unevenness of charge on the image bearing member by exposing the image bearing member to an exposure beam; and another guiding member provided on the exposure unit, the another guiding member being configured and positioned to guide the first unit during mounting and dismounting of the first unit, wherein the another guiding member is positioned across a vertical line passing through the center of gravity of the first unit from the guiding member of the second unit.

10. An image forming apparatus comprising:

first supporting means for supporting an image bearing means for bearing an image, the first supporting means being detachably mountable to the image forming apparatus;

second supporting means for supporting fixing means for fixing a toner image; on a recording material transferred from the image bearing means, the second supporting means being detachably mountable to the image forming apparatus and being disposed on an upper side of the first supporting means; and a conveying path to covey the recording material from the first supporting means to the second supporting means, wherein the second supporting means includes guiding means for guiding the first supporting means during mounting and dismounting of the first supporting means when the second supporting means is mounted to the image forming apparatus.

11. The image forming apparatus according to claim 10, wherein an upper portion of the first supporting means slides along the guiding means in a longitudinal direction of the first supporting means during mounting and dismounting of the first supporting means.

12. The image forming apparatus according to claim 10, further comprising:

another guiding means for guiding the first supporting means during mounting and dismounting of the first supporting means, the another guiding means being provided on the image forming apparatus, wherein the another guiding means is positioned across a vertical line passing through the center of gravity of the first supporting means from the guiding means of the second supporting means.

13. The image forming apparatus according to claim 10, wherein the guiding means is composed of a resin material comprising means for substantially blocking heat transmitted towards the first supporting means.

14. The image forming apparatus according to claim 10, wherein the second supporting means is detachably mountable to the image forming apparatus in a direction orthogonal to a longitudinal direction of the second supporting means.

15. The image forming apparatus according to claim 10, further comprising:

exposure means for forming an electrostatic image on the image bearing means by emitting light of an image on the image bearing means;

development means for developing the electrostatic image on the image bearing means; and optical discharging means for optically discharging the image bearing means, wherein the exposure means, the development means, and the optical discharging means are disposed adjacent to the first supporting means horizontally besides, below, and above the first supporting means, respectively.

16. The image forming apparatus according to claim 10, wherein the guiding means comprises a rail.

17. The image forming apparatus according to claim 10, wherein the guiding means is supported by the fixing means.

18. The image forming apparatus according to claim 10, further comprising:

exposure means for removing unevenness of charge on the image bearing means by exposing the image bearing means to an exposure beam; and another guiding means for guiding the first supporting means during mounting and dismounting of the first supporting means, where the another guiding means is provided on the exposure means, wherein the another guiding means is positioned across a vertical line passing through the center of gravity of the first supporting means from the guiding means of the second supporting means.

* * * * *

UNITED STATES PATENT AND TRADEMARK OFFICE

CERTIFICATE OF CORRECTION

PATENT NO. : 7,379,688 B2
APPLICATION NO. : 11/214952
DATED : May 27, 2008
INVENTOR(S) : Kikkawa It is certified that error appears in the above-identified patent and that said Letters Patent is hereby corrected as shown below:

COLUMN 1:
Line 53, “is” should be deleted.

COLUMN 3:
Line 41, “form” should read --from--.

COLUMN 4:
Line 16, “illustrates” should read --illustrates a--.
Line 19, “illustrates” should read --illustrates a--.
Line 49, “illustrates” should read --illustrates a--.
Line 51, “illustrates” should read --illustrates a--.

COLUMN 7:
Line 1, “counter clockwise” should read --counterclockwise--.

COLUMN 8:
Line 44, “apparatus” should read --apparatus,-- and “embodiment” should read --embodiment,--.

COLUMN 10:
Line 52, “besides,” should read --beside--.

COLUMN 11:
Line 13, “image;” should read --image--.
Line 18, “covey” should read --convey--.

UNITED STATES PATENT AND TRADEMARK OFFICE

CERTIFICATE OF CORRECTION

PATENT NO. : 7,379,688 B2
APPLICATION NO. : 11/214952
DATED : May 27, 2008
INVENTOR(S) : Kikkawa It is certified that error appears in the above-identified patent and that said Letters Patent is hereby corrected as shown below:

COLUMN 12:
Line 20, “besides,” should read --beside,--.

Signed and Sealed this

Third Day of February, 2009

John Doll

JOHN DOLL
*Acting Director of the United States Patent and Trademark Office*